US006637597B2

(12) United States Patent
Yin

(10) Patent No.: US 6,637,597 B2
(45) Date of Patent: Oct. 28, 2003

(54) DUAL FUNCTION PORTABLE COMPUTER BAG

(75) Inventor: Memphis Zhihong Yin, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 114 days.

(21) Appl. No.: 09/947,794

(22) Filed: Sep. 6, 2001

(65) Prior Publication Data

US 2003/0042158 A1 Mar. 6, 2003

(51) Int. Cl.[7] ..... B65D 85/30

(52) U.S. Cl. ..... 206/576; 206/320; 206/701; 383/4; 383/902

(58) Field of Search ..... 190/124, 125, 190/1, 8; 206/320, 216, 218, 701, 576; 383/4, 902, 105, 109

(56) References Cited

U.S. PATENT DOCUMENTS 5,419,473 A * 5/1995 Lamar ..... 224/632
6,305,587 B1 * 10/2001 Miller ..... 224/153
6,354,477 B1 * 3/2002 Trummer ..... 224/575
6,446,809 B2 * 9/2002 Flynn ..... 206/523

* cited by examiner

*Primary Examiner*—Jacob K. Ackun

(57) ABSTRACT

A dual function portable computer bag serves its conventional function as a carrying device for a portable computer and associated accessories and also serves an additional function as an ergonomically appropriate padded back support for a user thereby converting a conventional chair and table into an ergonomically appropriate and comfortable workstation for a portable computer user.

8 Claims, 3 Drawing Sheets

DUAL FUNCTION PORTABLE COMPUTER BAG

BACKGROUND OF THE INVENTION

Portable computers, e.g., laptop and notebook computers, provide advantage in their portability, but require certain additional accessories to enhance portability. Among such accessories, portable computer users often carry power supply or transformer devices and mouse or pointer input devices. In addition, some portable computer users carry peripheral devices such as external disk drives, CDROM drives, modems, and a broad spectrum of additional auxiliary equipment often used and carried with a portable computer. As such, portable computer users often carry, in association with their computer and accessories, a bag or carrying case. In some instances, the user dedicates a conventional briefcase or other similar carrying device as a conveyance for their portable computer and associated accessories. In other instances, the user obtains a special purpose bag or case particularly constructed and designed for portable computers and the typical accessories carried therewith.

Thus, people in their portable or mobile use of computing devices, likely transport such portable computing devices in a bag or carrying case. This is especially true for persons traveling with their portable computer. In use, the person finds an available work site, e.g., a chair and table, and sets up their portable computer by removing the portable computer and accessories from the bag and making the necessary connections for power and communication therebetween. While the portable computer is in use, the bag remains at hand but serves no useful purpose until the user returns the portable computer and accessories to the bag for transport.

Because the user often seeks out whatever available work site can be found, such work environments typically do not provide the user with a comfortable or ergonomic work environment. Nevertheless, such computer users often find it necessary to work extended hours at such ergonomically unacceptable temporary workstations. For example, consider a portable computer user traveling and finding need to set up a portable computer at an available location not typically designed for such use. Such user seeks out the nearest table and chair, e.g., a conference room or a hotel room chair and table. The user suffers ergonomically, i.e., endures an unacceptably uncomfortable work environment not matching their needs. As a result, the user may not be as productive as possible and may not be capable of enduring such ergonomically unacceptable work conditions for sufficient time to complete a given task.

Thus, portable computer users suffer from fatigue due to poor ergonomic working positions assumed while doing work out of the home or office, e.g., while traveling and staying at a hotel and the like. A significant contributing factor to such poor ergonomic working positions is the need to select for use a chair and table not typically intended for a computer user.

It would be desirable, therefore, to provide a portable computer user with improved ergonomic working conditions without requiring modifications at the work site, i.e., allowing the portable user to make use of whatever work site can be found such as typical chairs and tables often the only temporary work environments made available for the portable computer user.

SUMMARY OF THE INVENTION

A dual function portable bag according to the present invention includes and interior compartment suitable in size to accommodate a portable computing device. An opening relative to the interior compartment provides access to the interior compartment for placing and removing a portable computing device. The exterior surface of the bag presents a contour having a first portion and a second portion, the first portion having a thickness less than the second portion. In a first use of the bag, a portable computing device is carried in the bag in conventional fashion. In a second use of the bag, however, while using the portable computing device, the bag converts an ergonomically unacceptable work site into an ergonomically acceptable work site by placing the bag in a lumbar-supporting position relative to the user. More particularly, the first portion of the bag is positioned below the second portion of the bag and the second portion of the bag, i.e., the thicker portion, provides lumbar support for the user.

The subject matter of the present invention is particularly pointed out and distinctly claimed in the concluding portion of this specification. However, both the organization and method of operation of the embodiments that accord with the invention, together with further advantages thereof, may best be understood by reference to the following description taken with the accompanying drawings wherein like reference characters refer to like elements.

BRIEF DESCRIPTION OF THE DRAWINGS

For a better understanding of the claimed invention, and to show how the same may be carried into effect, reference will now be made, by way of example, to the accompanying drawings in which:

DETAILED DESCRIPTION OF THE PREFERRED EMBODIMENT

Figure 1:
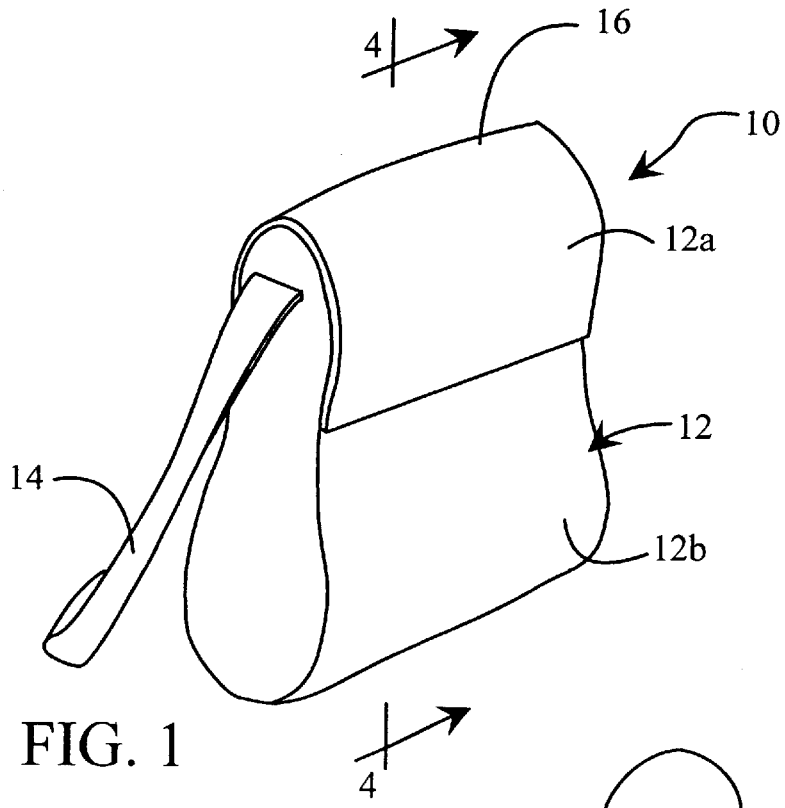
FIG. 1 illustrates in perspective a dual function portable computer bag according to a preferred embodiment of the present invention.

FIG. 1 illustrates in perspective a travel bag 10 according to a preferred embodiment of the present invention. In FIG. 1, travel bag 10 includes a main body 12 and a carrying handle or strap 14. A top flap 16 covers an opening (not shown in FIG. 1) providing access to the interior of bag 10. As will be described more fully hereafter, bag 10 serves as a travel bag for a portable computer, e.g., a laptop or notebook portable electronic device. As may be appreciated, flap 16 opens to allow ingress and egress of a portable computer and accessories relative to the interior of bag 10. Strap 14 allows a user to carry bag 10 along with its contents, i.e., a portable computer and various accessories associated therewith. In this aspect, bag 10 serves the conventional function of transporting and protecting a portable computer and associated accessories.

Bag 10 differs from conventional design, however, in its general shape and resiliency and in important ergonomic features provided thereby. More particularly, body 12 includes an upper portion and a lower portion that differ in their respective thicknesses. In the particular embodiment illustrated in FIG. 1, the lower portion 12*b* of body 12 is somewhat thicker than the upper portion 12*a*. Also, and as will be discussed more fully hereafter, body 12 of bag 10 presents a generally padded exterior configuration and serves as back support for a portable computer user while the user is using a portable computer.

Figure 2:
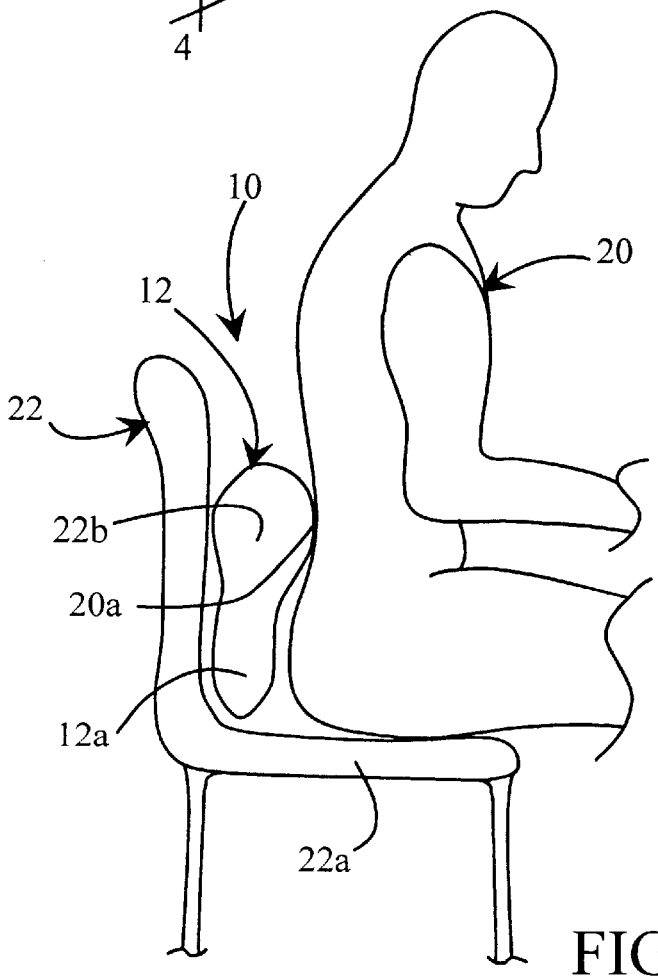
FIG. 2 illustrates use of the bag of FIG. 1 as a lumbar support.

FIG. 2 illustrates schematically use of bag 10 as a padded back support. In FIG. 2, a person 20 sits at a chair 22 with bag 10 therebetween to convert a conventional chair 22 into an ergonomically comfortable workstation. More particularly, bag 10 has been flipped from its orientation as illustrated in FIG. 1 to locate the portion 12*a* in a lower position and to locate the portion 12*b* in an upper position. As such, portion 12*a* of bag 10 rests against the upper-facing portion of chair 22 at seat 22*a*. This positions portion 12*b* adjacent to lumbar region 20*a*. Portion 12*b* of bag 10 thereby rests against the lateral-facing back 22*b* of chair 22. Bag 10 sits between person 20 and chair 22 and provides at the lower or lumbar region 20*a* of person 20 ergonomic support relative to chair 22. The shape of bag 10, i.e., having portion 12*b* of greater thickness relative to portion 12*a*, supports user 20 in an ergonomically desirable fashion to make chair 22 substantially more comfortable as a workstation for person 20, especially when the person is sitting at chair 22 for an extended period of time. More particularly, user 20 should desirably sit in an upright position as indicated in FIG. 2 in a "working position" differing from a "relaxing" position one might otherwise assume when making use of a conventional chair 22. As may be appreciated, bag 10 encourages such upright working position by its location as illustrated in FIG. 2 urging user 20 into an appropriate posture. Thus, bag 10 converts chair 22 from its normal intended use, i.e., as a sitting or relaxing chair, into a workstation chair having an ergonomically appropriate support for person 20 at lumbar region 20*a*.

Figure 3:
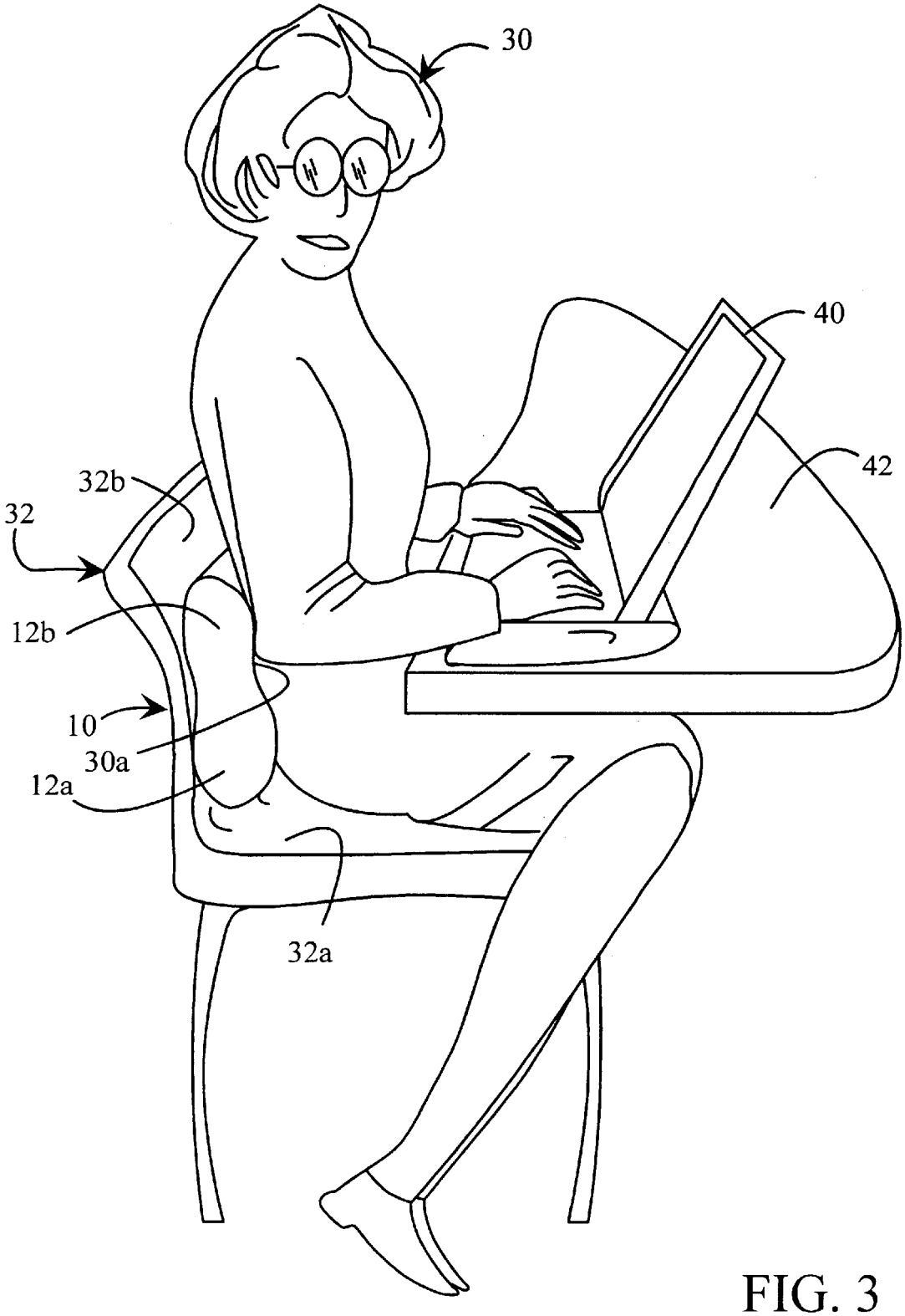
FIG. 3 illustrates use of the bag of FIG. 1 as a lumbar support while making use of a portable computer at a conventional table and chair.

FIG. 3 illustrates use of bag 10 as a lumbar support for a portable computer user 30 sitting in a chair 32 and making use of a portable computer 40 resting on a table 42. User 30 has taken a position at chair 32 and table 42 to operate portable computer 40. In other words, user 30 has found chair 32 and table 42 and taken the opportunity to set up a temporary work site making use of computer 40 at that location. Even though chair 32 and table 42 are not particularly well suited as a computer work site, i.e., not ergonomically desirable for a portable computer user such as user 30, bag 10 serves the important ergonomic function of providing user 30 with support in the lower back or lumbar region 30*a*. The relatively smaller body portion 12*a* rests in a lower position against the seat 32*a* while the relatively larger body portion 12*b* assumes the upper position engaging lumbar region 32*a*. Thus, bag 10 is captured between user 30 at the lumbar region 32*a* and the seat 32*a* and back 32*b* of chair 32.

As may be appreciated, bag 10 also carries portable computer 40. Thus, user 30 has available bag 10 for use as a back support when making use of portable computer 40. Normally, a computer carrying bag lacks utility while the portable computer is being used. In FIG. 3, however, the portable computer carrying bag, e.g., bag 10, serves an important ergonomic function making user 30 more comfortable and allowing user 30 to more productively make use of portable computer 40.

Figure 4:
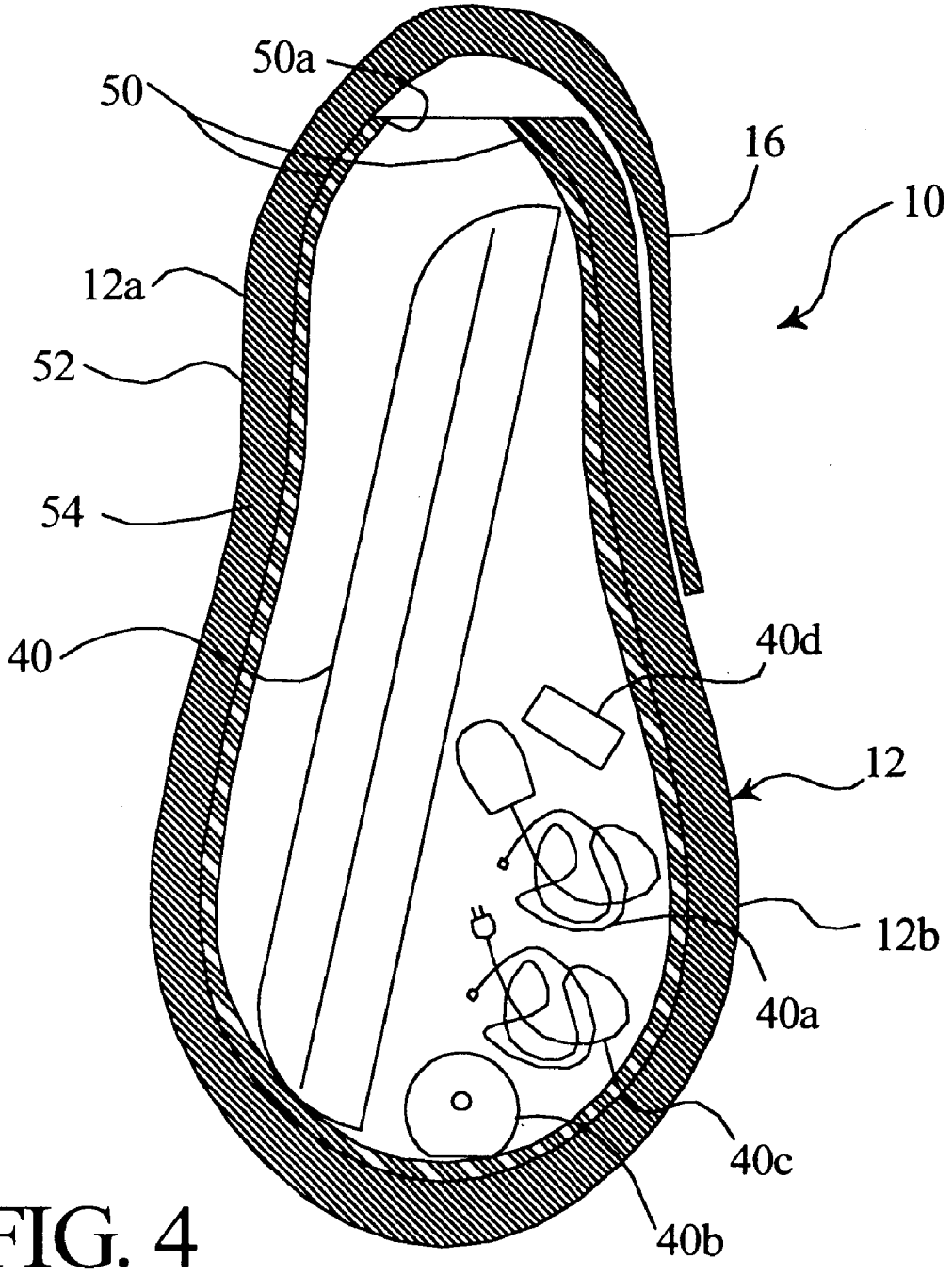
FIG. 4 illustrates in cross section the bag of FIG. 1 as taken along lines 4—4 of FIG. 1.

FIG. 4 illustrates a cross section of bag 10 as taken along lines 4—4 of FIG. 1. In FIG. 4, bag 10 contains portable computer 40 along with an assortment of accessories, e.g., a mouse 40*a*, transformer 40*b*, power cord 40*c*, and peripheral device 40*d*. As may be appreciated, peripheral device 40*d* as illustrated herein represents any one or more of a variety of peripheral devices, e.g., disk drives, modems and the like. Furthermore it will be understood that the contents of bag 10, in addition to portable computer 40, may include a variety of items as are typically found in association with a person traveling and making use of portable computer 40. Furthermore, it will be understood that bag 40 may be accommodated with additional storage compartments (not shown) and the like particularly suited for a specific portable computer 40 accessory components.

FIG. 4 illustrates the basic structural components of a particular embodiment of bag 10 including an internal molded flexible plastic structure 50 establishing the basic overall shape of bag 10, i.e., establishing a portion 12*a* of less thickness relative to portion 12*b*. As seen in the view of FIG. 4, this particular embodiment of bag 10 assumes a generally "figure eight" shape with portion 12*a* assuming a relatively smaller loop portion of the "figure eight" shape and body portion 12*b* assuming a relatively larger loop formation of the "figure eight" shape. It will be understood, however, that the particular shape adopted for this embodiment of the present invention is not a limiting aspect of the invention. A structural aspect of the present invention includes differentiation in thickness and an ability to provide a padded lumbar support. In other words, the distance across portion 12*b* is greater than the distance across portion 12*a*. An overall smooth contoured ergonomically appropriate back support permits user 30 to place the relatively larger-dimensioned body portion 12*b* in the lumbar region 30*a* for appropriate back support with the relatively smaller body portion 12*a* in a lower position, i.e., below portion 12*b*, when in use as a lumbar support and as illustrated in FIG. 3.

Structure 50 includes and opening 50*a* adjacent flap 16 and permits access to the interior of bag 10. The remainder of structure 50 provides a generally contoured smooth shape as indicated to produce an ergonomically appropriate and comfortable overall shape including the thickness differential provided relative to portions 12*a* and 12*b*. Exterior cover material 52 may be of a variety of compositions, e.g., leather, soft plastic, cloth, and the like. A foam padding 54 lies intermediate exterior material 52 and structure 50 and establishes a padded relationship between a user and structure 50 for comfort and for establishing a generally soft and contoured support at the lumbar region of the user.

Thus, the present invention proposes a dual function portable computer bag converting a conventional chair into an ergonomically appropriate workstation chair providing for the user lumbar support while using a portable computer at a conventional chair and table. A bag according to the present invention is preformed into an ergonomically appropriate shape with materials stiff enough to provide support, yet flexible enough to establish a contoured and ergonomically appropriate support for the user which fits well with the user's back when seated in a conventional chair. The portable computer user makes use of the bag while using the portable computer. Normally the bag has no use whatsoever when the portable computer is in use. In accordance with the present invention, however, the bag finds an important function in addition to its transport function, i.e., converts a conventional chair into an ergonomically appropriate workstation by supporting the user in their lower back or lumber region while making use of a portable computer at a conventional chair and table.

While illustrated herein as having a "figure eight" shape, it will be understood that embodiments of the present invention may be implemented in a broad variety of geometries. Important lumbar support functions may be provided in such variety of geometries having bag portions of differing thickness whereby a relatively thicker portion may be positioned against a user's lumbar back region and the relatively thinner portion providing a base or resting structure against a chair seat and accommodating the contour of the users lower back region.

Generally, a travel bag in accordance with the present invention includes a left side, a right side, a front side, a back side, a left side, a right side, a top side, and a bottom side. The front side and back side each may be considered as having an upper portion and a lower portion. The front-to-back separation between the upper portion of the front side and the upper portion of the back side is less than the front-to-back separation between the lower portion of the front side and the lower portion of the back side. In other words, a travel bag that accords with the present invention includes a variation in thickness to create a relatively thicker portion accommodating a user's lumbar back region for ergonomic support thereof. In one particular embodiment, this thickness variation is accommodated by a generally "figure eight" shape of the left side and right side.

The internal molded flexible plastic structure 50 includes sufficient structural integrity to receive and support the lumbar region of the user, and possesses sufficient resiliency to present a comfortable structure as captured between the lumbar region and a chair back. As may be appreciated, the amount of resiliency provided by structure 50 in combination with the amount and character of padding 54 establishes a comfortable back support. A greater amount of padding 54 may be provided when a relatively less resilient structure 50 is employed. Similarly, a more resilient structure 50 requires less padding 54, but may deform unacceptably under certain conditions. The particular combination of resiliency in structure 50 and character of padding 54 may be adjusted to achieve a desired overall product configuration.

It will be appreciated that the present invention is not restricted to the particular embodiment that has been described and illustrated, and that variations may be made therein without departing from the scope of the invention as found in the appended claims and equivalents thereof.

What is claimed is:

1. A portable computer bag comprising:

an interior compartment suitable in size to accommodate a portable computing device therein, said portable computing device being of size on the order of at least one of a laptop and a notebook computing device;

an opening relative to said interior compartment providing access to said interior compartment; and an exterior surface that presents an exterior contour having a first portion and a second portion, said first portion having thickness less than said second portion, said exterior surface including a left side, a right side, a front side, a back side, a top side, and a bottom side, said exterior surface defining an exterior contour following a figure-eight contour as viewed in cross-section along a line parallel to said front side, said back side, said top side and said bottom side, a first loop portion of said figure-eight shape being formed by a first portion of said front side, said bottom side, and a first portion of said back side, a second loop portion of said figure-eight shape being formed by second portion of said front side, said top side, and a second portion of said back side, said first loop portion being smaller in area than said second loop portion.

2. A portable computer bag according to claim 1 further comprising at least one of a handle and strap, said at least one of said handle and strap being attached to said exterior surface.

3. A portable computer bag according to claim 1 further comprising an opening relative to said interior compartment providing access to said interior compartment.

4. A portable computer bag according to claim 3 further comprising a flap removably positionable relative to said opening.

5. A portable computer bag according to claim 1 further comprising a portable computer within said interior compartment.

6. A portable computer bag comprising:

an interior compartment suitable in size to accommodate a portable computing device therein, said portable computing device being of size on the order of at least one of a laptop and a notebook computing device;

an opening relative to said interior compartment providing access to said interior compartment; and an exterior surface that presents an exterior contour having a first portion and a second portion, said first portion having thickness less than said second portion, said exterior surface including a left side, a right side, a front side, a back side, a top side, and a bottom side, said left and right sides each defining in shape thereof a figure-eight having a first loop portion and a second loop portion, said first loop portion spanning at its widest portion a first given distance, said second loop portion spanning at its widest portion a second given distance, said first given distance being less than said second given distance, said front side coupling a front portion of said first loop portion and said second loop portion of said left side to a front portion of said first loop portion and said second loop portion of said right side, said back side coupling a back portion of said first loop portion and said second loop portion of said left side to a back portion of said first loop portion and said second loop portion of said right side.

7. A portable computer bag according to claim 6 wherein a first separation between said front side and back side corresponds to said first given distance.

8. A portable computer bag according to claim 6, wherein a second separation between said front side and back side corresponds to said second given distance.

* * * * *